US006688938B1

(12) United States Patent
Lee

(10) Patent No.: US 6,688,938 B1
(45) Date of Patent: Feb. 10, 2004

(54) TOY VEHICLE

(76) Inventor: Kyoung Chul Lee, 66-85 Bongchun 6-dong, Kwanak-ku, Seoul 151-056 (KR)

( * ) Notice: Subject to any disclaimer, the term of this patent is extended or adjusted under 35 U.S.C. 154(b) by 0 days.

(21) Appl. No.: 10/069,038

(22) PCT Filed: Aug. 16, 2000

(86) PCT No.: PCT/KR00/00911

§ 371 (c)(1),
(2), (4) Date: Jun. 11, 2002

(87) PCT Pub. No.: WO01/14034

PCT Pub. Date: Mar. 1, 2001

(30) Foreign Application Priority Data

Aug. 19, 1999 (KR) ..... 1999-17194 U
May 31, 2000 (KR) ..... 2000-15472 U

(51) Int. Cl.[7] ..... A63H 33/26
(52) U.S. Cl. ..... 446/129; 446/465
(58) Field of Search ..... 446/129, 130, 446/131, 132, 133, 134, 135, 136, 137, 138, 139, 433, 465, 153, 155; 701/23; 180/167, 168

(56) References Cited

U.S. PATENT DOCUMENTS 4,990,117 A 2/1991 Yonezawa
5,667,420 A * 9/1997 Menow et al. ..... 446/433

FOREIGN PATENT DOCUMENTS

| | | |
|---|---|---|
| DE | 3914909 | 11/1990 |
| JP | 04-135591 | 5/1992 |
| JP | 05-317526 | 12/1993 |
| JP | 09-313744 | 12/1997 |

* cited by examiner

*Primary Examiner*—Jacob K. Ackun
*Assistant Examiner*—Jamila Williams
(74) *Attorney, Agent, or Firm*—Darby & Darby

(57) ABSTRACT

The object of this invention is to provide a toy vehicle, having a permanent magnet ring (55, 65) fixedly fitted over each of the front and rear wheels. This toy vehicle (100, 200, 300 or 400) is thus movable on a magnetic slope surface and a metal vertical wall in addition to a horizontal surface. The toy vehicle has a V-shaped groove (15) through the center on its bottom between the front and rear wheels, thus being movable on a metal stairway while climbing over the top corner of each step of the stairway. The toy vehicle is further provided with a floater (80) on its body and a plurality of vanes (95) on each wheel, thus being movable on the surface of the water. This toy vehicle easily moves on the rails between two or more sections as desired, thus more effectively getting children interested in playing such toy vehicles.

10 Claims, 9 Drawing Sheets

TOY VEHICLE

CROSS-REFERENCE TO RELATED APPLICATIONS

This application is a U.S. national phase application under 35 U.S.C. §371 based upon co-pending International Application NO. PCT/KR00/009111 filed Aug. 16, 2000, the entire disclosure of which is incorporated herein by reference. The international application was published in the English language on Mar. 1, 2001 under Publication No. WO 01/14304.

TECHNICAL FIELD

The present invention relates to toy vehicles and, more particularly, to a toy vehicle designed to move on a horizontal surface, a magnetic slope surface, a magnetic vertical wall, a magnetic stairway, or the surface of the water, thus being varied in its playing ways and allowing children to naturally acquire a variety of scientific attainments in addition to developing both their initiative spirits and their power of observation while playing such toy vehicles, the toy vehicle being also designed to be movable in a circular way within a predetermined section of a simple railway and to be selectively movable between two or more sections of the railway as desired.

BACKGROUND ART

As well known to those skilled in the art, toy vehicles are a kind of most generalized toys. A variety of toy vehicles, including non-powered primitive toy vehicles and powered luxury toy vehicles, have been proposed and marketed. In the prior art, the powered toy vehicles are typically designed to move using mechanical power created by, for example, springs, or electric power created by, for example, motors. Some motorized deluxe toy vehicles, designed to have operational functions almost completely similar to those of genuine vehicles, have been proposed and marketed.

In addition, the powered toy vehicles may be designed to move along a circular railway. In such a case, the conventional railways for powered toy vehicles typically consist of a set of rail units, which may be assembled together into a variety of railway patterns.

However, such a conventional powered toy vehicle, designed to move along a circular railway or on a horizontal flat surface, is problematic in that the toy vehicle only moves along the railway or on the flat surface using the rotating force of its wheels, and so it is limited in playing ways and make children easily tired of playing it. Such toy vehicles also undesirably fail to allow children to acquire scientific attainments or to develop their initiative spirits while playing the toy vehicles.

The powered and wheeled toy vehicles, designed to repeatedly move on limited railways, merely perform a simple and limited movement on the railways, thus undesirably reducing the scientific thinking ability of children and disturbing a development in both the infinite imagination and initiative spirits of the children, and deteriorating children's power of observation. Another problem of the conventional powered toy vehicles used on limited railways resides in that it is necessary to array the railways on peculiar large areas, thereby consuming the areas and forcing users to somewhat carefully treat the railways arrayed on the peculiar areas.

DISCLOSURE OF THE INVENTION

Accordingly, the present invention has been made keeping in mind the above problems occurring in the prior art, and an object of the present invention is to provide a toy vehicle, which has a permanent magnet ring fixedly fitted over each of the wheels, thus being automatically movable on a magnetic slope surface and a metal vertical wall in addition to a horizontal surface, and which is easily played by children without being limited by the area and is varied in its playing ways, thereby getting the children interested in playing the toy vehicles, and which allows children to naturally acquire a variety of scientific attainments, such as information of characteristics of magnets, in addition to developing children's initiative spirits while playing the toy vehicles.

Another object of the present invention is to provide a toy vehicle, which has a V-shaped groove through the center on its bottom between the front and rear wheels, thus being movable on a metal stairway while climbing over the top comer of each step of the stairway.

A further object of the present invention is to provide a toy vehicle, which is provided with a floater on its body and a plurality of vanes or blades on each wheel, thus being movable on the surface of the water while floating on the water.

A still another object of the present invention is to provide a toy vehicle, which is also designed to easily move on rails between two or more sections as desired, thus more effectively getting children interested in playing such toy vehicles.

In order to accomplish the above objects, an embodiment of the present invention provides a toy vehicle having a body with front and rear wheels, comprising a permanent magnet ring fitted over the rim of each of the wheels so as to allow the toy vehicle to be movable on the surface of a magnetic structure.

In the above toy vehicle, a V-shaped groove is formed through the center on the bottom of the body between the front and rear wheels. The above toy vehicle may further comprise a floater provided on the bottom of the body, and a plurality of vanes regularly provided on the sidewall of each of the front and rear wheels, thus forming a water wheel, whereby the toy vehicle is movable on the surface of the water in a desired direction by a rotating force of the wheels, with the body floating on the water.

Another embodiment of this invention provides a toy vehicle with a plurality of main traveling wheels, comprising a body having a drive assembly operated in conjunction with the main traveling wheels through at least one drive gear, a plurality of auxiliary traveling wheels installed at the top surface of the body and operated in conjunction with the drive assembly through a driven gear, with a permanent magnet formed on the circumferential surface of each of the auxiliary traveling wheels to have a predetermined constant thickness, and a power transmission means connecting the drive and driven gears to each other so as to allow the drive and driven gears to be operated in conjunction with each other.

In a modification of the above embodiment, the power transmission means comprises a mid gear rotatably mounted to the body. This mid gear connects the drive and driven gears to each other so as to allow the main and auxiliary traveling wheels to be rotatable in the same direction.

In another modification of the above embodiment, the power transmission means comprises a bracket mounted to the body so as to be changeable in its position by a lever, a mid gear mounted to the bracket, and an idle gear mounted to the bracket while always engaging with the mid gear.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
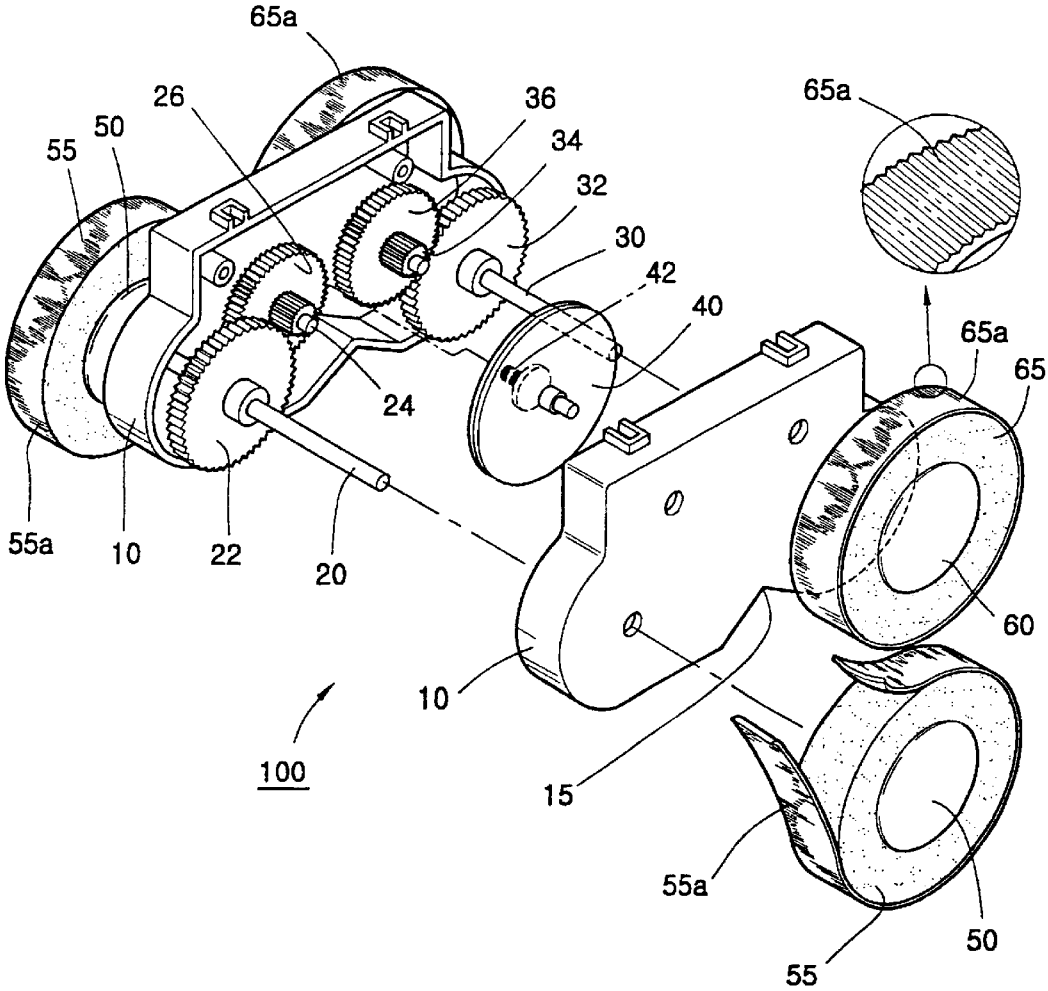
FIG. 1 is an exploded perspective view, showing the construction of a toy vehicle in accordance with the primary embodiment of the present invention.

Reference now should be made to the drawings, in which the same reference numerals are used throughout the different drawings to designate the same or similar components.

Figure 2:
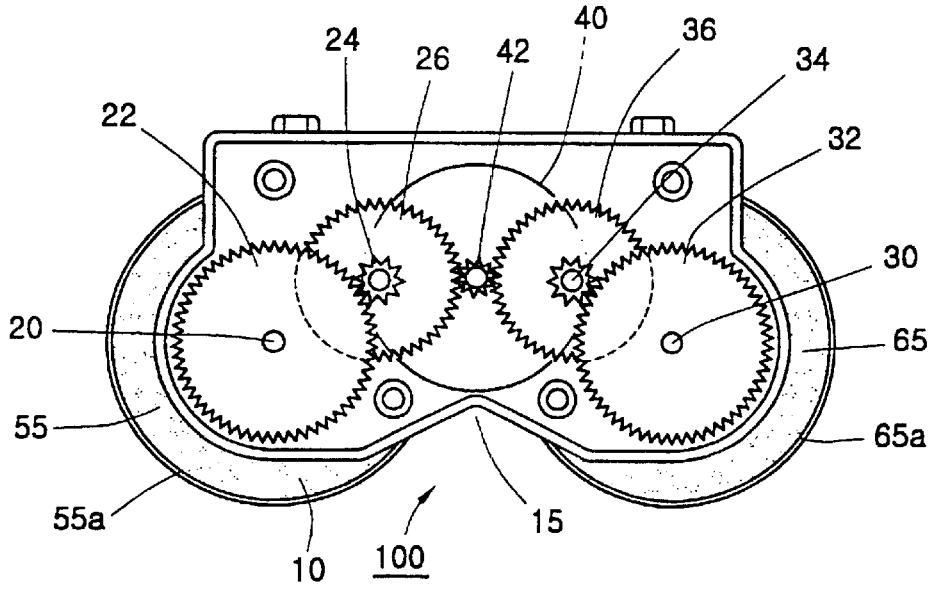
FIG. 2 is a side-sectional view of the toy vehicle of FIG. 1, when the parts of the vehicle are completely assembled into a single body.

FIG. 1 is an exploded perspective view, showing the construction of a toy vehicle in accordance with the primary embodiment of this invention. FIG. 2 is a side-sectional view of the toy vehicle of FIG. 1. As shown in the drawings, the toy vehicle. 100 according to the primary embodiment of this invention comprises a body 10, with front and rear axles 20 and 30 transversely passing through the body 10 at the front and rear portions of the body 10. Two front wheels are mounted to opposite ends of the front axle 20, while two rear wheels are mounted to opposite ends of the rear axle 30. Each of the front and rear wheels has a rim 50 or 60, with a permanent magnet ring 55 or 65 being fixedly fitted over each of the front and rear rims 50 and 60. In the present invention, the permanent magnet rings 55 and 65 have high magnetic force allowing the toy vehicle 100 to be movable along a magnetic railway or on a metal wall while being brought into close contact with the railway or the wall at its wheels.

As shown in the drawings, a plurality of gears are provided within the body 10 of the toy vehicle 100 and form a drive force retaining means for the vehicle 100 in the same manner as a conventional non-powered toy vehicle. That is, a first large gear 22 or 32 is fitted over each of the front and rear axles 20 and 30 at the central portion. A first small gear 24 or 34 is rotatably shafted to the body 10 while engaging with an associated one of the two first large gears 22 and 32. A second large gear 26 or 36 is concentrically integrated with each of the first small gears 24 and 34, thus being rotatable along with an associated first small gear 24 or 34. A second small gear 42 commonly engages with the two second large gears 26 and 36 at its diametrically opposite positions. The second small gear 42 is concentrically integrated with a flywheel 40 and is shafted to the body 10 so as to be rotatable along with both second large gears 26 and 36.

In the above toy vehicle 100, a V-shaped groove 15 is formed through the center on the bottom of the body 10 between the front and rear wheels.

Figure 3:
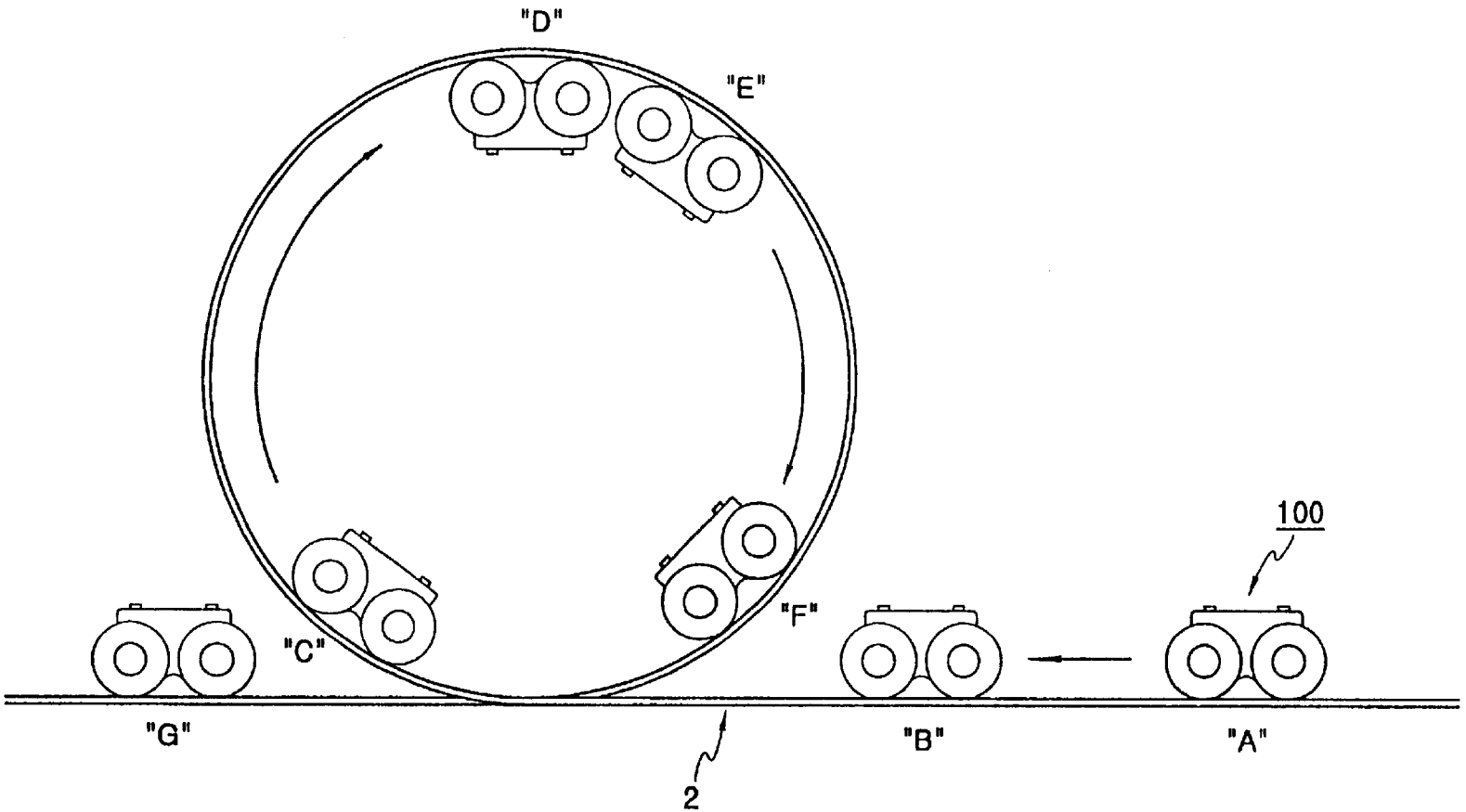
FIG. 3 is a view, showing the toy vehicle of FIG. 1 moving along a vertically coiled metal railway.

FIG. 3 is a view, showing the toy vehicle 100 of FIG. 1 moving along a vertically coiled metal railway 2.

In order to move the toy vehicle 100 on the railway 2, the toy vehicle 100 is primarily laid on a start position "A" designated on a horizontal portion of the metal railway 2 after repeatedly and manually moving the toy vehicle 100 forward several times on a support surface. When the toy vehicle 100 is laid on the start position "A" of the metal railway 2 as described above, the wheels of the vehicle 100 are rotated due to inertia force in the same manner as expected from a conventional toy vehicle. In such a case, the rotating force of the wheels is transmitted to the flywheel 40 through the power transmission means in the order of the first large gears 22 and 32, the first small gears 24 and 34, the second large gears 26 and 36, and the second small gear 42, thus rotating the flywheel 40. As the heavy flywheel 40 is rotated as described above, the momentum of the flywheel 40 is transmitted to the front and rear axles 20 and 30 through the power transmission means in the order of the second small gear 42, the second large gears 26 and 36, the first small gears 24 and 34, and the first large gears 22 and 32, thereby continuously rotating the front and rear wheels at an almost uniform rotational speed for a predetermined period of time. Therefore, the toy vehicle 100 starts the position "A" to move along the railway 2 to reach an end position "G" on another horizontal portion of the railway 2 while orderly passing on the positions B, C, D, E and F. When the toy vehicle 100 moves along the railway 2 as described above, the toy vehicle 100 having the magnet rings 55 and 65 on its wheels is continuously attached to the metal railway 2 without being removed from the railway 2 even though the vehicle 100 moves on the coiled portion of the railway 2, with its upper part undermost, at the upper positions "D" and "E" of the coiled portion.

In the present invention, since each of the wheels is completely covered With a magnet ring 55 or 65 on its circumferential surface, a desired smooth movement of the vehicle 100 on the metal railway 2 may be disturbed by the magnetic attraction between the wheels and the railway 2. However, such a magnetic attraction can be effectively overcome by making the flywheel 40 heavier to increase the momentum of the flywheel 40 allowing an increase in the drive force for the vehicle 100.

That is, when the vehicle 100 moves on the railway 2, the front and rear wheels continuously come into tangential contact with the top surface of the railway 2. In such a case, the magnetic attraction, generated between each wheel and the railway 2 at a portion in back of the tangential contact line of the wheel, intend to move the vehicle 100 backward. On the other hand, the magnetic attraction, generated between each wheel and the railway 2 at a portion in front of the tangential contact line of the wheel, intend to move the vehicle 100 forward. The two types of magnetic attraction are thus offset each other, thus being almost completely free from disturbing the movement of the vehicle 100 on the railway 2. Therefore, it is noted that only the magnetic attraction, generated between each wheel and the railway 2 at the tangential contact line, intends to stop the vehicle 100 on the railway 2 during the movement of the vehicle 100. However, the magnetic attraction, generated, between the wheels and the railway 2 at the tangential contact lines, is almost negligible since the tangential contact lines of the wheels only form a very small area. Therefore, it is possible for the toy vehicle 100 to smoothly move along the metal railway 2 while being less likely to be disturbed by the magnetic attraction between the wheels and the magnetic rings 55 and 65 when the drive force for the vehicle 100 is increased by making the flywheel 40 heavier.

Figure 4A:
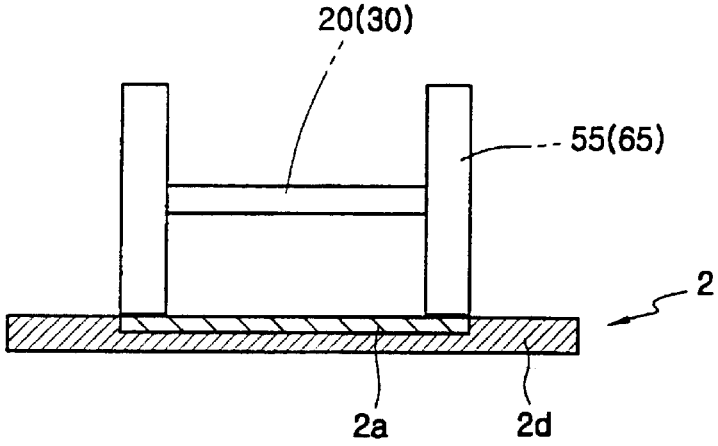
FIGS. 4*a* and 4*b* are sectional views, showing the cross-sections of metal railways used for the toy vehicle of FIG. 3 in accordance with different modifications of the primary embodiment of this invention.
Figure 4B:
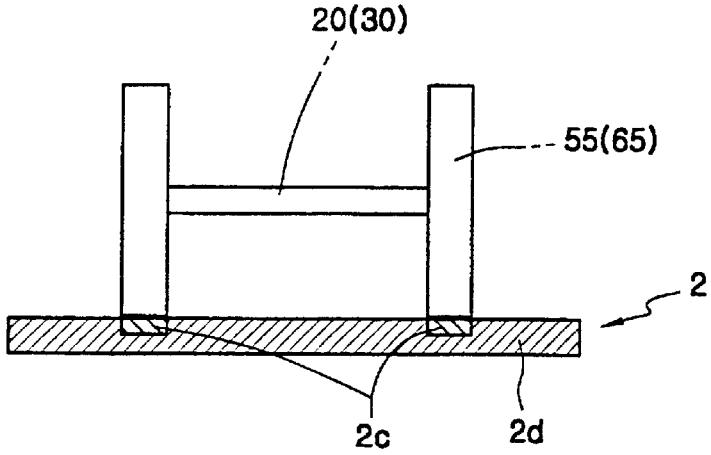

FIGS. 4*a* and 4*b* are sectional views, showing the cross-sections of metal railways 2 in accordance with different modifications of the primary embodiment of this invention. In the railway 2 of FIG. 4*a*, a longitudinal metal strip 2*a*, which has a width equal to the distance between the outside edges of the wheels, is arrayed along the central axis on the top surface of the rail 2*d*. In the railway 2 of FIG. 4*b*, two longitudinal metal strip 2*c*, which individually have the same width as that of each wheel, are parallely arrayed along the top surface of the rail 2*d*. When using a railway 2 of FIG. 4*a* or 4*b*,it is possible to almost completely prevent the wheels, individually covered with a permanent magnet ring 55 or 65 on its circumferential surface, from being undesirably removed from the metal strip(s) 2*a* or 2*c* of the railway 2 during a movement of the vehicle 100 along the railway 2. Therefore, the toy vehicle 100 stably moves along the railway 2 without being undesirably removed from the rail 2*d*.

Figure 5:
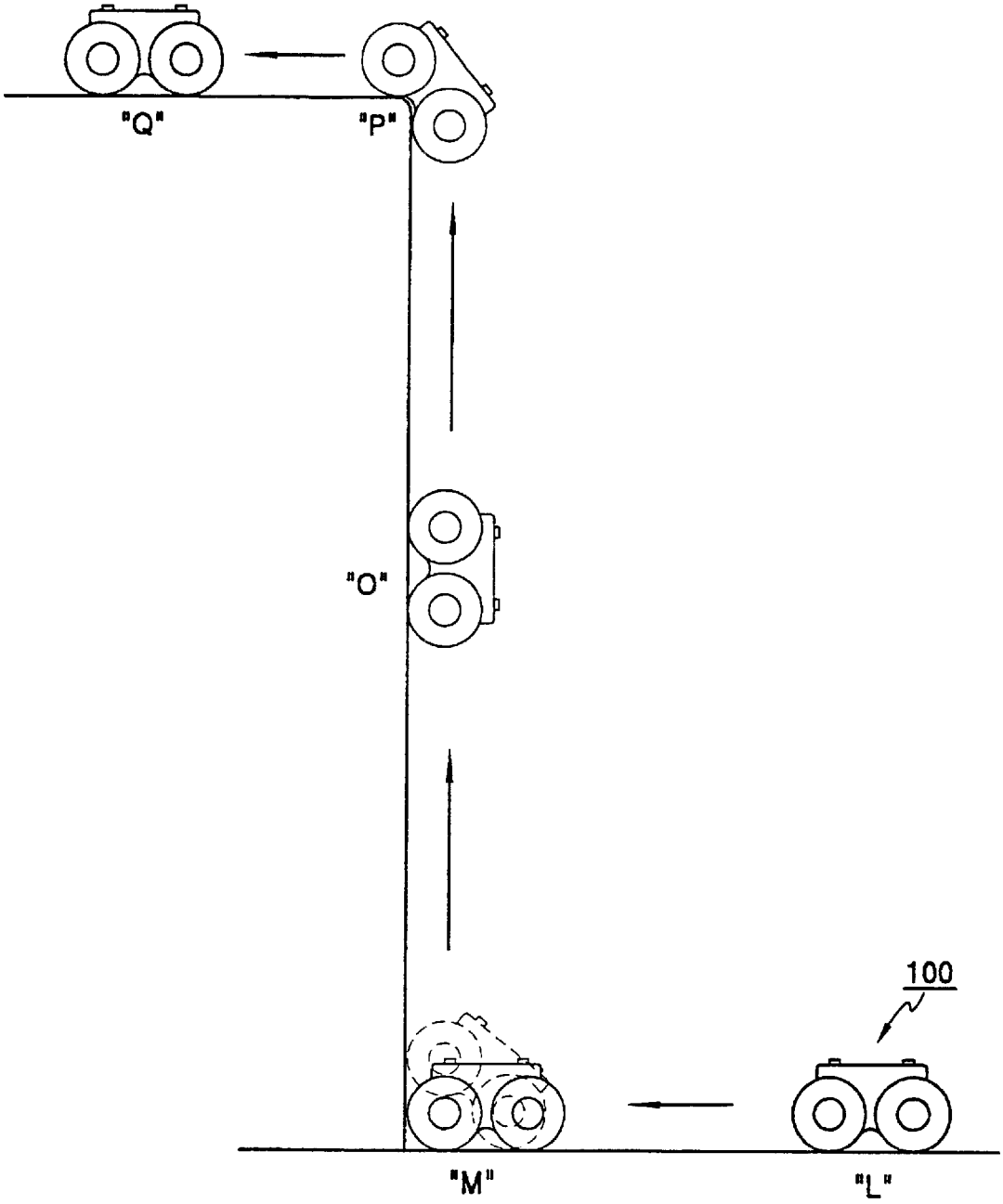
FIG. 5 is a view, showing the toy vehicle of FIG. 1 moving on a vertical metal wall.

FIG. 5 is a view, showing the toy vehicle 100 of FIG. 1 moving on a vertical metal wall.

In order to move the toy vehicle 100 on such a vertical metal wall, the toy vehicle 100 is primarily laid on a start position "L" designated on a horizontal surface after repeatedly and manually moving the toy vehicle 100 forward several times on a support surface. When the toy vehicle 100 is laid on the start position "L" as described above, the wheels of the vehicle 100 are rotated due to inertia force. In such a case, the rotating force of the wheels is transmitted to the flywheel 40 in the same manner as that described for FIG. 3. As the heavy flywheel 40 is rotated, the momentum of the flywheel 40 is transmitted to the front and rear axles 20 and 30 through the power transmission means, thereby continuously rotating the front and rear wheels at an almost uniform rotational speed for a predetermined lengthy period of time. Therefore, the toy vehicle 100 starts the position "A" to reach the position "M" around the bottom corner of the vertical wall, and moves up along the vertical wall. In such a case, due to the magnetic rings 55 and 65 fitted over the wheels, it is possible for the toy vehicle 100 to move up along the vertical wall without being slipped down from the wall.

When the toy vehicle 100 moves up along the wall as described above, the vehicle 100 reaches the top corner "P" of the wall after passing by the middle position "O" of the wall. In such a case, the top corner "P" of the wall is received in the V-shaped groove 15 of the body 10 after the front wheels completely pass over the top comer "P" to be laid on the horizontal portion around the top corner "P". The toy vehicle 100 thus smoothly climbs over the top comer "P" to reach a position "Q" on a horizontal surface. Since the toy vehicle 100 smoothly moves up along a vertical wall and passes over the top comer "P" of the wall as described above, the vehicle 100 smoothly climbs all the steps of a stairway.

In the toy vehicle 100 of this invention, a rubber lining 55*a* or 65*a* may be fitted over the permanent magnet ring 55 or 65 of each wheel so as to improve the traveling stability of the vehicle 100 and to prevent an undesired slip of the wheels on a surface. The rubber linings 55*a* and 65*a* also prevent the vehicle 100 from being damaged or broken in the case of a collision against a hard structure. In such a case, it is preferable to make the rubber linings 55*a* and 65*a* thinner as possible, thus minimizing an undesired reduction in the magnetic force of the permanent magnet rings 55 and 65 due to the rubber linings 55*a* and 65*a*.

Figure 6:
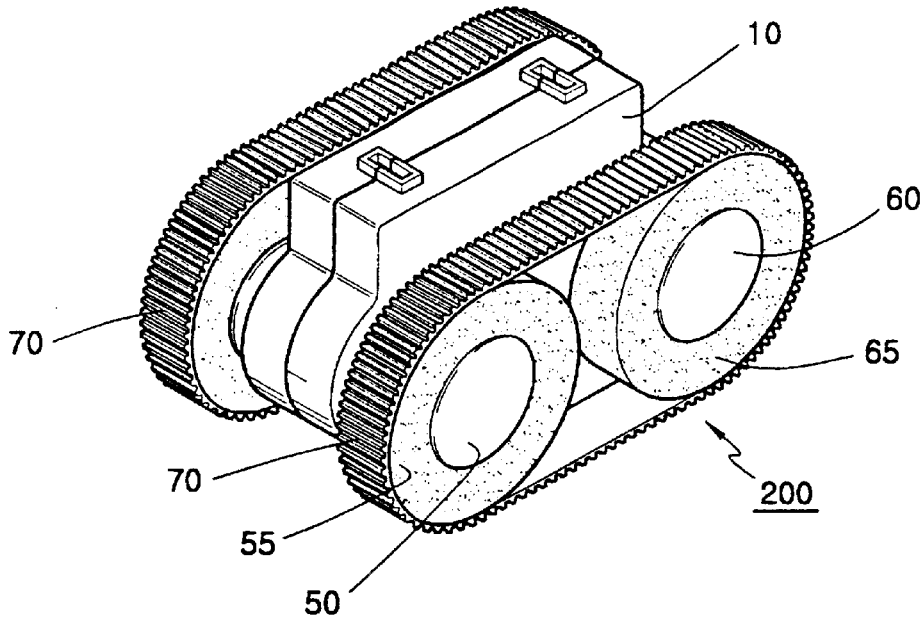
FIG. 6 is a perspective view of a toy vehicle in accordance with the second embodiment of the present invention.

FIG. 6 is a perspective view of a toy vehicle in accordance with the second embodiment of the present invention. As shown in the drawing, the toy vehicle 200 according to the second embodiment has a belt-type crawler 70, which passes over each front wheel and an associated rear wheel in the same as a caterpillar tread of a conventional military tank or tractor and integrates the rotating force of both wheels. In this second embodiment, each of the front and rear wheels of the toy vehicle 200 is closely covered with a permanent magnet ring 55 or 65 on its circumferential surface in the same manner as that described for the primary embodiment.

When the toy vehicle 200 having opposite crawlers 70 moves on the steps of a stairway, the crawlers 70 always come into close contact with the top comer of each step, and so the vehicle 200 more smoothly and effectively climbs all the steps of such a stairway.

Figure 7:
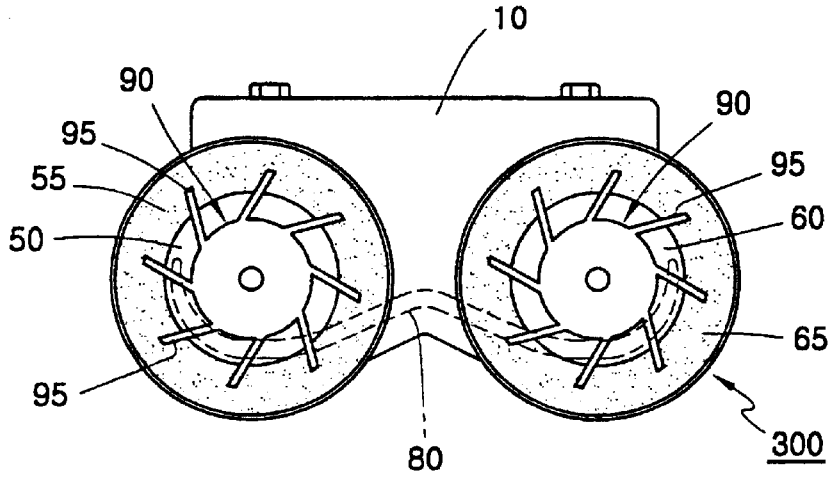
FIG. 7 is a side-sectional view of a toy vehicle in accordance with the third embodiment of the present invention.

FIG. 7 is a side-sectional view of a toy vehicle in accordance with the third embodiment of this invention. In the toy vehicle 300 according to the third embodiment, a floater 80 is provided on the bottom of the body 10 for allowing the body 10 to float on the water. This toy vehicle 300 of this embodiment also has a water wheel 90 on each of the front and rear wheel. The water wheels 90 hydraulically propel the vehicle 300 forward when the front and rear wheels are rotated.

Each of the water wheels 90 is formed by a plurality of vanes 95, regularly provided on the sidewall of each of the front and rear wheels of the vehicle 100. The above vanes 95 are individually inclined forward, thus thrusting the water to the back when the front and rear wheels are rotated on the water. When the toy vehicle 100 according to the third embodiment enters into the stagnated water while moving on a metal railway 2 or on another surface, the body 10 primarily floats on the surface of the water due to the floater 80 of the body 10. In addition, the vanes 95 of the water wheels 90 are rotated along with the front and rear wheels by the momentum of the flywheel 40, thus thrusting the water to the back. Therefore, the toy vehicle 300 is movable on the surface of the water forward by the rotating force of the wheels, with the body 10 floating on the water due to the floater 80.

In the toy vehicles 100, 200 or 300 according to the primary to third embodiments of this invention, a permanent magnet ring 55 or 65, having a predetermined thickness, is fitted over the rim of each of the front and rear wheels so as to allow the toy vehicle to be stably movable on the surface of a variety of magnetic structures without being undesirably removed from the structures. However, it should be understood that the toy vehicle of this invention is not limited to the above-mentioned construction, but may be somewhat freely altered to be movable along different rails between two or more sections as will be described herein below.

Figure 8:
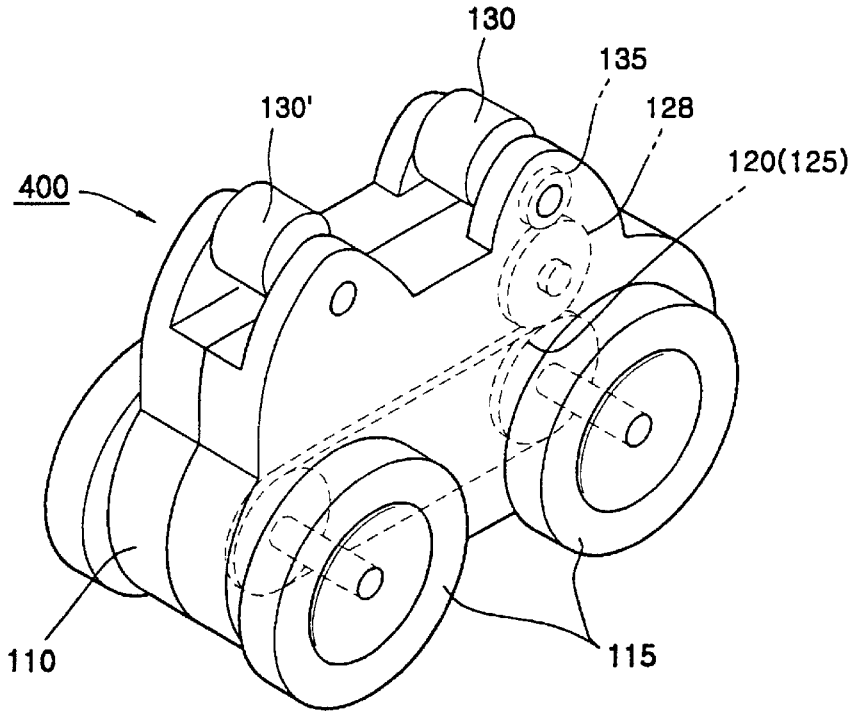
FIG. 8 is a perspective view of a toy vehicle designed to be movable on different rails between two or more sections in accordance with the fourth embodiment of the present invention.

FIG. 8 is a perspective view of a toy vehicle 400 designed to be movable along different rails between two or more sections in accordance with the fourth embodiment of this invention.

In the fourth embodiment of this invention, the toy vehicle 400 has a plurality of main traveling wheels 115, with a drive assembly 120 set in the body 110 of the vehicle 400 and used for driving the wheels 115. The above drive assembly 120 is operated in conjunction with the wheels 115 through one or more drive gears 125.

In the toy vehicle 400 of this embodiment, the main traveling wheels 115 consist of front and rear wheels positioned at the front and rear portions on the bottom of the body 110. When it is desired to drive either of the front and rear wheels 115, the rotation of the wheels 115 in conjunction with the drive assembly 120 may be accomplished by one drive gear 125. However, when it is desired to drive the front and rear wheels 115 at the same time, it may be necessary to set two drive gears 125 in the vehicle 400. In addition to the drive gear(s) 125, the drive assembly 120 also consists of a mechanical or electric rotational power source, with a gear train used for transmitting the rotational force of the power source to the drive gear(s) 125 while controlling rpm and torque of the rotational force.

In the toy vehicle 400 according to the fourth embodiment, two auxiliary traveling wheels 130 and 130 are rotatably installed at the top surface of the body 110 and are operated in conjunction with the drive assembly 120 through a driven gear 135. In such a case, the auxiliary traveling wheels 130 and 130 have to be partially projected upward from the top surface of the body 110 so as to be brought into contact with the upper rail part of a railway 140 while being free from any interference in the same manner as that of the main traveling wheels 115 that come into contact with the lower rail part of the railway 140. The driven gear 135 is concentrically fixed to the first auxiliary traveling wheel 130 at a sidewall of the selected wheel 130.

A permanent magnet is formed on the circumferential surface of each of the auxiliary traveling wheels 130 and 130 to have a predetermined constant thickness. In such a case, the permanent magnet has an annular shape and necessarily forms a magnetic force capable of substantially supporting the total weight of the vehicle 400 when the vehicle 400 moves along the upper rail part of the railway 140 using the auxiliary traveling wheels 130 and 130'. Meanwhile, the main traveling wheels 115 may be provided with such a permanent magnet ring or may be entirely made of nonmagnetic material without having any magnet ring.

In the drawing, the reference numeral 130' denotes the second auxiliary traveling wheel, which has a permanent magnet ring, but does not have any driven gear 135 different from the first auxiliary traveling wheel 130. This second auxiliary traveling wheel 130 intends to guide a stable movement of the toy vehicle 400 on the upper rail part of the railway 140. Of course, such a second auxiliary traveling wheel 130 used as an idle wheel may be removed from the vehicle 400. In addition, the second auxiliary traveling wheel 130 may be provided with a driven gear 135 for an operation in conjunction with the drive assembly 120 through the driven gear 135. When the toy vehicle 400 is provided with only one auxiliary traveling wheel 130, it is preferable to set the wheel 130 at the center of gravity of the vehicle 400 for accomplishing a stable movement of the vehicle 400.

In the toy vehicle 400, a power transmission means engages with the drive and driven gears 125 and 135, thus connecting the drive and driven gears 125 and 135 to each other and allowing the drive and driven gears 125 and 135 to be operated in conjunction with each other. In the preferred embodiment, the power transmission means comprises a mid gear 128, which is rotatably mounted to the body 110 and engages with both gears 125 and 135 to connect the gears 125 and 135 to each other so as to allow the main and auxiliary traveling wheels 115 and 130 to be rotatable in the same direction. When it is desired to drive the first and second auxiliary traveling wheels 130 and 130' at the same time, two mid gears 128 are provided for the two auxiliary wheels 130 and 130'. In such a case, the two mid gears 128 may engage with two drive gears 125 or may be operated in conjunction with each other by an endless belt.

In the present invention, it is preferable to make the auxiliary traveling wheels 130 and 130' having a diameter smaller than that of the main traveling wheels 115 for accomplishing a desired good appearance of the vehicle 400. When the auxiliary traveling wheels 130 and 130' have such a small diameter, it is necessary to appropriately control rpm of the wheels 130 and 130' by controlling the gear ratio of the driven gear 135 to the drive gear 125. Therefore, it is possible to control the speed of the vehicle 400 in the case of a movement using the auxiliary traveling wheels 130 and 130' to be equal to or different from the case of a movement using the main traveling wheels 115. Since the mid gear 128 does not affect the gear ratio of the driven gear 135 to the drive gear 125, it may be somewhat freely designed as desired.

Figure 9:
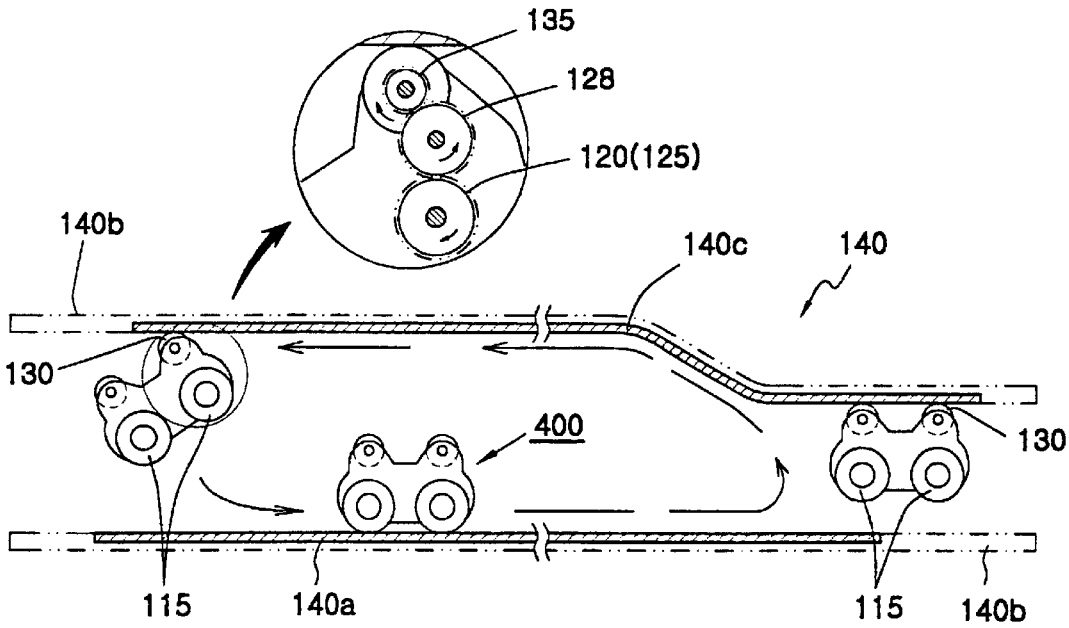
FIG. 9 is a view, showing the toy vehicle of FIG. 8 moving along the upper and lower rail parts within one section of a railway.

FIG. 9 is a view, showing the toy vehicle 400 of FIG. 8 continuously moving along the upper and lower rail parts within one section of a railway. As shown in the drawing, the toy vehicle 400 moves along a double railway 140 consisting of upper and lower rail parts. In the double railway 140, the lower rail part 140 is a horizontal part and consists of a magnetic portion 140*a* and a nonmagnetic portion 140*b*. The upper rail part 140 has a double-bent magnetic portion 140*c*. In the railway 140, the nonmagnetic portions 140b of the upper and lower rail parts are positioned oppositely at the outside surfaces of the two rail parts oppositely.

During a movement of the toy vehicle 400 along such a railway 140, the vehicle 400 primarily moves along the lower rail part of the railway 140 in a conventional manner. When the vehicle 400 completely reaches the nonmagnetic portion 140*b* on the lower rail part, the auxiliary traveling wheels 130 and 130' of the vehicle 400 is positioned close to the upper rail part, and so the vehicle 400 is magnetically lifted up to be attached to the upper rail part at its auxiliary traveling wheels 130 and 130'. In such a case, both drive and driven gears 125 and 135 are rotated clockwise as best seen in FIG. 9, and so the vehicle 400 moves to the back while running along the upper rail part with its auxiliary traveling wheels 130 and 130. When the vehicle 400 completely reaches the nonmagnetic portion 140*b* of the upper rail part, the vehicle 400 is dropped onto the lower rail part due to gravity and moves along the lower rail part forward. Therefore, the vehicle 400 continuously moves along the railway 140 in a direction as shown by the arrow of FIG. 9 during a period of time the drive gear 125 is effectively rotated in a direction.

Since the toy vehicle 400 is lifted up from the lower rail part to the upper rail part due to magnetic force and is dropped from the upper rail part onto the lower rail part due to gravity during a movement along the railway 140, it is possible for the main traveling wheels 115 to be free from any permanent magnet ring. In addition, it is also possible to entirely make the lower rail part using a nonmagnetic material while removing the magnetic portion 140a from the lower rail part.

The above railway 140 has a simple construction allowing the peculiar area for the railway 140, thus conserving the area for playing the vehicle 400. This also allows a user of the toy vehicle 400 to be free from repeatedly assemble or disassemble the railway 140, and so the parts of the railway 140 may be less likely to be easily damaged or lost.

Figure 10:
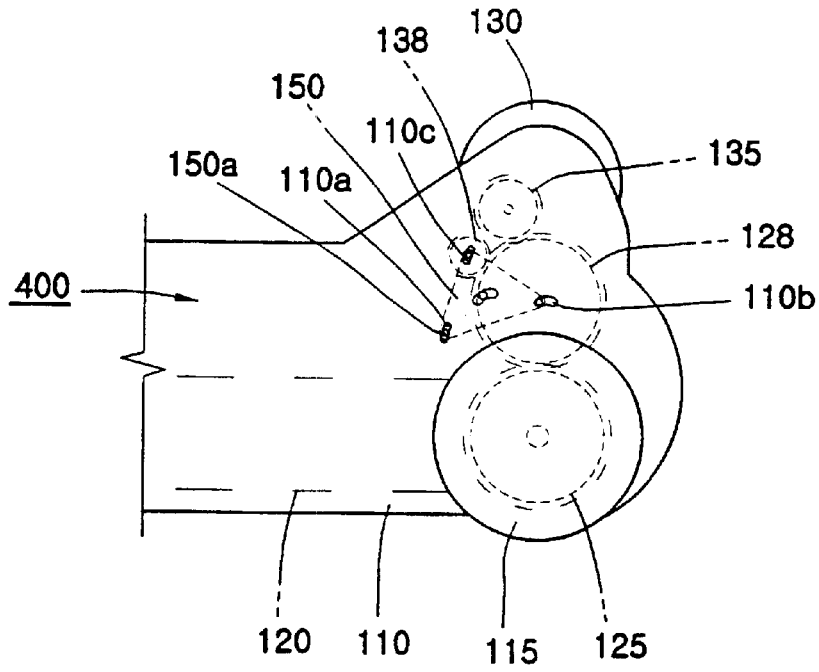
FIG. 10 is a view, showing the construction of a part of a toy vehicle in accordance with a modification of the fourth embodiment of this invention.
Figure 11A:
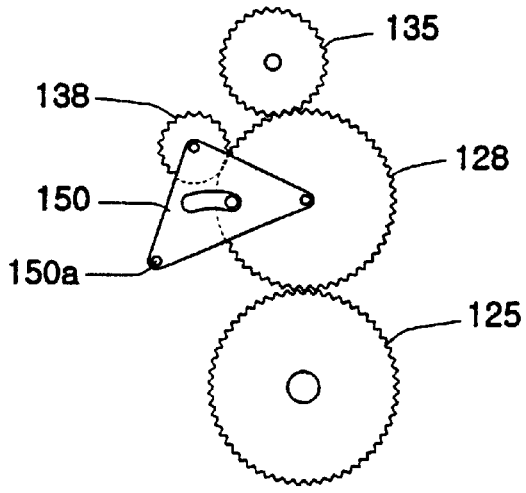
FIGS. 11*a* and 11*b* are views, respectively showing the construction and operation of a traveling mode changing unit included in the toy vehicle of FIG. 10.
Figure 11B:
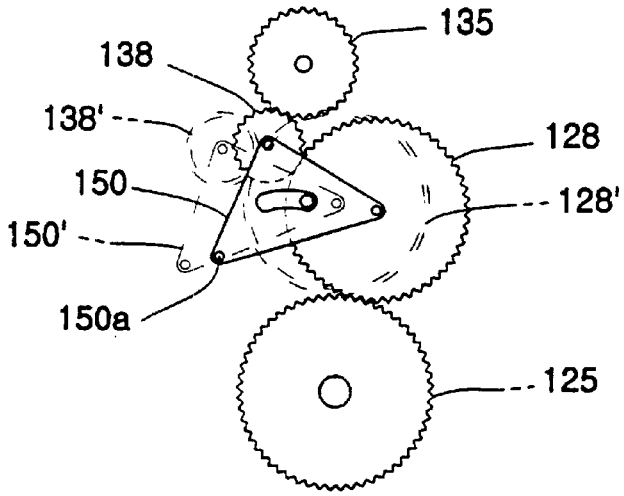

FIG. 10 is a view, showing the construction of a part of the toy vehicle 400 in accordance with a modification of the fourth embodiment of this invention. FIGS. 11*a* and 11*b* are views, respectively showing the construction and operation of a traveling mode changing unit included in the toy vehicle 400 of FIG. 10.

The toy vehicle 400 of FIG. 10 has a power transmission means, which acts as a part of the traveling mode changing unit and comprises a bracket 150 mounted to the body 110. The power transmission means also has a mid gear 128 mounted to the bracket 150, and an idle gear 138 mounted to the bracket 150 while engaging with the mid gear 128. The above bracket 150 has a triangular-shaped member, with two rotating shafts of both the mid gear 128 and the idle gear 138 being held to the triangular bracket at two corners. A lever 150*a* is mounted to the triangular bracket 150 at the remaining one of the three comers of the bracket 150. This lever 150 is a handle, which is substantially projected from the body 110 and is used for changing the position of the bracket 150 relative to the body 110 of the vehicle 100 when necessary.

As shown in FIGS. 11*a* and 11*b*, the above bracket 150 is movable between first and second positions. That is, the bracket 150 brings the mid gear 128 into direct engagement with the drive gear 135 at its first position of FIG. 11*a*, and brings the mid gear 128 into indirect engagement with the drive gear 135 through the idle gear 138 of the bracket 150 at its second position of FIG. 11*b*. Therefore, it is possible to change the operational mode of the auxiliary traveling wheels 130 and 130 between two modes by changing the position of the bracket 150 between the two positions as desired. In such a case, the positional change of the bracket 150 results in a change of the rotating direction of the drive gear 135 or of the auxiliary traveling wheels 130 and 130'.

In other words, when the bracket 150 is positioned at its first position of FIG. 11*a*, the toy vehicle 400 can repeatedly and continuously move along a circular rail in the same manner as that described for the primary to third embodiments. However, the toy vehicle 400, with the bracket 150 positioned at its second position of FIG. 11*b*, can change its moving direction or can move from one section of a railway to another section of the railway. In FIG. 11*b*, the reference numerals 128', 138' and 150' respectively denote the positions of the mid gear 128, the idle gear 138 and the bracket 150 when the bracket 150 positioned at its first position. That is, the positions 128', 138' and 150 of the mid gear 128, the idle gear 138 and the bracket 150, shown by the phantom lines in FIG. 11*b*, are equal to the positions of them shown by the solid lines in FIG. 11*a*. In the toy vehicle 400, the lever 150*a*, mid gear 128 and idle gear 138 are movably held by curved slits 110*a*, 110*b* and 110*c*, formed on the body 110, at their central shafts so as to be movable under the guide of the curved slits.

In order to accomplish a smooth movement of the lever 150*a*, mid gear 128 and idle gear 138 under the guide of the slits 10*a*, 10*b* and 110*c*, the slits 110*a*, 110*b* and 110*c* are formed to have desired lengths in a direction of the bracket's movement. In addition, the slits 110*a*, 110*b* and 110*c* movably receive the central shafts of the lever 150*a*,mid gear 128 and idle gear 138 so as to allow them to be smoothly movable as desired. However, in order to allow a selected position of the bracket 150 to be reliably locked to the body 110 without being undesirably changed in its position, a locking slot may be formed in the slit 110*a* of the lever 150*a*. Such a function of locking the selected position of the bracket 150 to the body 110 also may be accomplished by a biasing means, such as a plate spring, installed within the slit 110*a* of the lever 150*a*. The slit 110*b* for the mid gear 128 is formed to have the same radius of curvature as that of the drive gear 125, thus allowing the mid gear 128 to always engage with the drive gear 125 regardless of a movement of the bracket 150 between the two positions.

In the present invention, it is possible to electrically actuate the lever 150*a* using, for example, a motor or a solenoid valve. In such a case, it is preferable to control the operation of the motor or the solenoid valve through a remote control method.

Figure 12:
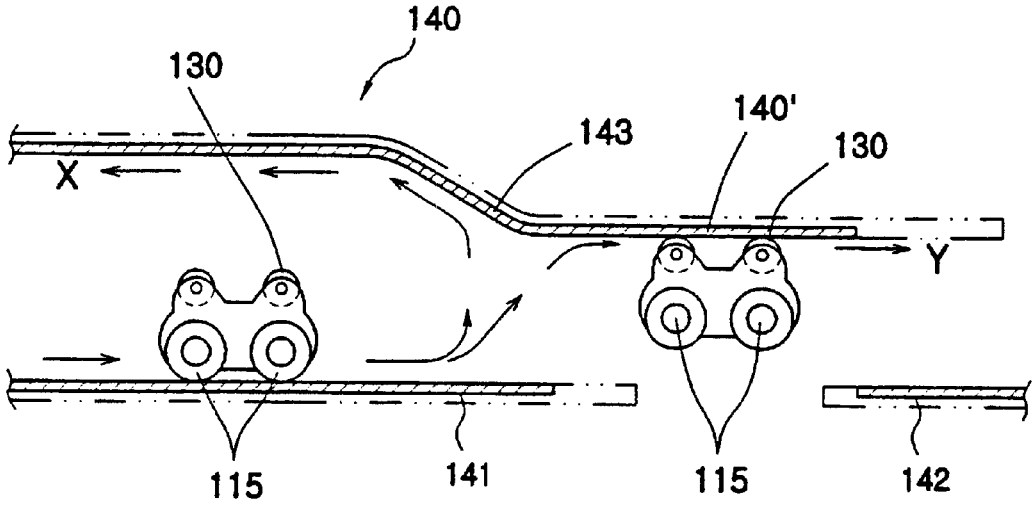
FIG. 12 is a view, showing the toy vehicle of FIG. 10 repeatedly moving along the upper and lower rail parts within one section of a railway or moving from the lower rail part within the section to the rail part within another section of the railway.

FIG. 12 is a view, showing the toy vehicle 400 of FIG. 10 repeatedly moving along the upper and lower rail parts within one section of a railway or moving from the lower rail part within the section to the rail part within another section of the railway.

As shown in the drawing, when the bracket 150 is positioned at its first position, with the idle gear 138 separated from the driven gear 135, the toy vehicle 400 repeatedly move along the lower rail part 141 and the upper rail part within one section of the railway 140, thus accomplishing a circular movement with the section as shown by the arrow "X" of FIG. 12 in the same manner as that described for FIGS. 8 and 9. However, when the position of the bracket 150 is changed from the first position to the second position, with the idle gear 138 brought into engagement with the driven gear 135, the toy vehicle 400 does not move to the back, but moves forward at a time the vehicle 400 is magnetically attached to the bent portion 143 of the upper rail part, thus accomplishing a movement from the lower rail part 141 within one section of the railway 140 to the rail part 142 of another section of said railway 140 as shown by the arrow "Y" of FIG. 12.

In order to accomplish the above-mentioned movement of the toy vehicle 400 from one section to another section of the railway 140, it is inevitably necessary to array the double-bent connection rail part 143 at a position between the horizontal rail part 141 of the first section and the other rail part 142 of the second section. In such a case, the connection rail part 143 has to be provided with a magnetic portion.

In the present invention, a simple linear railway, a curved railway or a circular railway may be used as the railway 140 without affecting the functioning of this invention.

In addition, when the body 110 of the toy vehicle 400 is made of a transparent plastic material through a molding process, the operation of the gear train in conjunction with a positional movement of the bracket 150 set within the transparent body 110 may be naturally observed by children from the outside of the body 110 while playing the vehicle 400. It is thus possible to improve the scientific thinking ability of the children.

Industrial Applicability

As described above, the present invention provides a toy vehicle. Different from a conventional toy vehicle designed to move on a horizontal surface, the toy vehicle of this invention has a permanent magnet ring fixedly fitted over each of the wheels, a V-shaped groove through the center on its bottom between the front and rear wheels, crawlers, a floater and a water wheel. Therefore, the toy vehicle of this invention can effectively and smoothly move on a curved metal railway, a vertical metal wall, a metal stairway, and the surface of the water, thus being varied in its playing ways. This finally allows children to naturally acquire a variety of scientific attainments in addition to developing both their initiative spirits and their power of observation while playing such toy vehicles.

This toy vehicle is also designed to be movable in a circular way within a predetermined section of a simple railway and to be selectively movable between two or more sections of the railway as desired. The toy vehicle thus gets the children interested in playing toy vehicles, and allows the children to naturally acquire the scientific attainments, such as information of characteristics of magnets.

Although a preferred embodiment of the present invention has been described for illustrative purposes, those skilled in the art will appreciate that various modifications, additions and substitutions are possible, without departing from the scope and spirit of the invention as disclosed in the accompanying claims. For example, the present invention may be preferably adapted to remote-controlled toy vehicles in addition to the vehicles of the preferred embodiments.

What is claimed is:

1. A toy vehicle having a body with front and rear wheels, comprising:

a permanent magnet ring fitted over a rim of each of said wheels so as to allow the toy vehicle to be movable on a surface of a magnetic structure, wherein a V-shaped groove is formed through a center on a bottom of said body between the front and rear wheels.

2. The toy wheel according to claim 1, wherein a rubber lining is fitted over the permanent magnet ring of each wheel so as to prevent an undesired slip of the wheels on the surface.

3. The toy vehicle according to claim 1, wherein a belt-type crawler passes over each front wheel and an associated rear wheel so as to integrate the rotating force of both wheels.

4. The toy vehicle according to claim 1, further comprising:

a floater provided on a bottom of the body; and a plurality of vanes regularly provided on a sidewall of each of said front and rear wheels, thus forming a water wheel, whereby the toy vehicle is movable on the surface of the water in a desired direction by a rotating force of the wheels, with the body floating on the water.

5. The toy vehicle according to claim 1, wherein said magnet rings provide sufficient magnetic force to maintain said vehicle in magnetic contact with said surface.

6. A toy vehicle with a plurality of main traveling wheels, comprising:

a body having a drive assembly, said drive assembly being operated in conjunction with said main traveling wheels through at least on drive gear;

a plurality of auxiliary traveling wheels installed at a top surface of said body and operated in conjunction with the drive assembly through a driven gear, with a permanent magnet formed on a circumferential surface of each of said auxiliary traveling wheels to have a predetermined constant thickness; and power transmission means connecting the drive and driven gears to each other so as to allow the drive and driven gears to be operated in conjunction with each other.

7. The toy vehicle according to claim 6, wherein permanent magnet is formed on a circumferential surface of each of said main traveling wheels to have a predetermined constant thickness.

8. The toy vehicle according to claim 6, wherein said power transmission means comprises a mid gear rotatably mounted to said body, said mid gear connecting the drive and driven gears to each other so as to allow the main and auxiliary traveling wheels to be rotatable in the same direction.

9. The toy vehicle according to claim 6, wherein said power transmission means comprises:

a bracket mounted to said body so as to be changeable in its position by a lever;

a mid gear mounted to said bracket; and an idle gear mounted to said bracket while always engaging with said mid gear.

10. The toy vehicle according to claim 9, wherein said lever, mid gear and idle gear are movably held by slits, formed on said body, at their central shafts so as to be movable under the guide of said slits.

* * * * *